US006425721B1

(12) United States Patent
Zysset

(10) Patent No.: US 6,425,721 B1
(45) Date of Patent: Jul. 30, 2002

(54) METHOD OF FORMING A SAFETY CAN END

(75) Inventor: Edgar H. Zysset, St. Cloud, FL (US)

(73) Assignee: Crown Cork & Seal Technologies Corporation, Alsip, IL ( * ) Notice: Subject to any disclaimer, the term of this patent is extended or adjusted under 35 U.S.C. 154(b) by 0 days.

(21) Appl. No.: 09/607,821

(22) Filed: Jun. 30, 2000

(51) Int. Cl.[7] ..... B21D 51/44
(52) U.S. Cl. ..... 413/8
(58) Field of Search ..... 413/8, 14, 15, 413/16, 56; 220/269, 270

(56) References Cited

U.S. PATENT DOCUMENTS

| | | | | | |
|---|---|---|---|---|---|
| 3,765,352 | A | * | 10/1973 | Schubert et al. | 413/17 |
| 3,939,787 | A | | 2/1976 | Morrison et al. | |
| 3,949,692 | A | | 4/1976 | DeLine et al. | |
| 3,986,632 | A | | 10/1976 | Morrison et al. | |
| 3,990,376 | A | | 11/1976 | Schubert et al. | |
| 4,018,178 | A | | 4/1977 | Klein et al. | |
| 4,052,949 | A | * | 10/1977 | Woodley | 413/14 |
| 4,129,085 | A | * | 12/1978 | Klein | 413/14 |
| 4,386,713 | A | * | 6/1983 | Baumeyer et al. | 220/269 |
| 4,394,927 | A | | 7/1983 | Zysset | |
| 4,406,378 | A | | 9/1983 | Zysset | |
| 4,455,114 | A | | 6/1984 | Zysset | |
| 4,540,105 | A | | 9/1985 | Wright | |
| 4,848,623 | A | * | 7/1989 | Saunders et al. | 413/14 |
| 5,038,956 | A | * | 8/1991 | Saunders | 220/270 |
| 5,069,356 | A | * | 12/1991 | Zysset | 220/270 |
| 5,252,019 | A | * | 10/1993 | Saunders et al. | 413/17 |
| 5,823,730 | A | | 10/1998 | La Rovere | |
| 5,927,536 | A | * | 7/1999 | Oyagi et al. | 413/17 |

* cited by examiner

*Primary Examiner*—Stephen F. Gerrity
*Assistant Examiner*—Louis Huynh
(74) *Attorney, Agent, or Firm*—Knoble & Yoshida, LLC

(57) ABSTRACT

A method of making a pressure-resistant easy-open end for a container is performed on a conventional easy-open end of the type that has a double-seaming portion, an end panel and a safety fold. The safety fold as is conventional includes an intermediate panel that is unitary with and overlies the end panel and that is connected to the end panel by a first bead, a top panel that is unitary with and overlies the intermediate panel and that is connected to the intermediate panel by a second bead, and a transition region that is unitary with and connects the top panel to the double-seaming portion. The method involves performing an operation on the conventional end so that the top panel is reformed to reside substantially within a second plane and so that the first and second planes intersect at the end panel at a location that is radially inward from said first bead. The result is a modified easy-open end that exhibits markedly improved resistance against pressure-induced failure.

13 Claims, 4 Drawing Sheets

METHOD OF FORMING A SAFETY CAN END

BACKGROUND OF THE INVENTION

1. Field of the Invention

This invention relates to easy-open metallic containers, which are defined as being openable by a consumer without a can opener or other tool, and methods for making such containers. More specifically, this invention relates to an improved method for making a full-open type easy-open closure that provides consumers protection against finger cuts while at the same time being resistant to pressure-induced failure.

2. Description of the Related Technology

An easy open end, for the purposes of this document, may be defined as a can end that is designed to be opened by a consumer without using a can opener or similar tool. A full-open type can end is, as opposed to a pour-type easy-open can end, designed to be completely removable from the can end during opening to provide unimpeded access to the inside of the can. Full-open type can ends are commonly utilized for packaging loose solids, such as mixed nuts or coffee, while pour-type can ends tend to be utilized for soft drinks or other beverages. Full-open type easy-open can ends are also used for packaging products of a non-food nature, such as tennis balls, which must be kept in a pressurized environment after manufacture to avoid deformation, particularly in the seam area.

When an end panel of an easy-open type closure separates as designed at a score line during opening, the resulting edges tend to be sharp, posing a possible danger to the consumer. One solution to this problem was presented in U.S. Pat. No. 3,705,363 to Elser, and was improved upon in U.S. Pat. No. 3,939,787 to Morrison et al. FIGS. 1 through 6 illustrate the progressive stages in the formation of the closure disclosed in the Morrison et al. patent. These steps are carried out in a conventional, progressive die-forming machine, and the application and use of such a machine should be quite clear to those skilled in the art of forming such closures. Therefore, the details of the dies themselves and the transfer mechanisms involved are omitted, since the major focus of interest is that of the closure itself rather than the precise configurations of the dies used. The Morrison et al. closure is made from a blank that is fabricated from relatively thin aluminum sheet material. This material is disclosed as being in the range of from 0.008 to 0.015 inches thickness.

In the first stage of the closure formation illustrated in FIG. 1, a blank A has a seaming panel 10 formed from the peripheral edges of the blank. The seaming panel 10 is later used to double seam this convenience closure onto the end of a conventional can. Attached to the seaming panel 10 is a perimetrical upstanding wall portion of the closure, which is known in the art as a chuck wall 12. In the initial forming steps shown in FIG. 1, two ledges 14 and 15 are formed. Also formed in this initial step is a bubble portion 16, which will eventually be formed into a rivet for attaching a pull tab to this closure. The bubble 16 is formed from a portion of a central panel 18 of the blank A. An upstanding wall portion 20 connects the ledge 14 to the ledge 15. A similar wall portion 22 is connected to the lower ledge 15 and to the central panel 18.

In the second stage of the forming operation shown in FIG. 2, the outer margin of the central panel 18 has been bent upon itself to form a loose loop 26, and the bubble 16 has been further shaped. Note that the loop 26, speaking with respect to the vertical center line of the entire closure blank A, has an inner portion 27 and an outer portion 28.

In FIG. 3, a scoring die 30 scores the blank A along an endless circular line 42 on the lower ledge 15. Also note that in FIG. 3, simultaneously with the scoring of the ledge 15, the upper ledge 14 and the upstanding wall portion 20 are bent to form a relatively loose loop 32.

In FIG. 4, the loop 26 has been bent upwardly so that the outer portion 28 of the loop 26 is lying in abutting relationship with the lower ledge 15. Similarly, the inner portion 27 of the loop 26 has been bent upwardly so that it is in abutting relationship with the outer portion 28 of the loop 26. Thus, at this point, there are three layers of material defining a panel fold 33 which has a projecting outer nose portion 34.

In FIG. 5, a pull tab 36 has been inserted over the completely formed bubble 16, and the bubble 16 has been compressed to form a rivet 38, which holds the pull tab 36 in place. The pull tab 36 includes a nose portion 40, which is preferably positioned such that its outermost edge lies approximately over the center line of the score line or severing line 42, which was placed in the lower ledge 15 by the scoring die 30.

FIG. 6 shows the final operation to complete the Morrison et al. closure. In this step, the loose loop 32 is folded inwardly, overlying completely the score line 42. It is to be noted that the loose loop 32 remains in a generally loose configuration, and the layers are not compressed together, as was the case with the loop 26. An end, or nose portion, 44 is positioned so that it is inward of the score line 42 and very close to the nose portion 40 of the pull tab 36. The loop 32 so folded constitutes a chuck wall fold 45.

As may be seen in FIG. 6 and in FIG. 7, which shows an unencumbered view of the completed conventional closure, the resulting safety fold 50 includes an upper bead 52 that is radiused so as to be unitary with an intermediate panel 54 at one end thereof and similarly with an upper panel 56 at a second end thereof that overlies the intermediate panel 54. A transition portion 57 is unitary with the upper panel 56 at one end and transitions the upper panel 56 into the chuck wall 12. The other end of the intermediate panel 54 is unitary with a lower bead 58 that is radiused so as to be unitary with the end panel 60 of the completed closure at a second end.

As can be visualized by viewing FIG. 7, the upper bead 52, because it protrudes slightly inwardly of the leftward edge of score line 42, will be positioned to contact a consumer's finger before the consumer's finger contacts with the potentially sharp edge that is formed during separation of the end panel 60 at the score line 42 during opening. As a result, some protection is afforded by this design to the consumer against finger cuts.

As may further be seen FIG. 7, in practice it has been common to manufacture such closures so that the intermediate panel 54 is inclined with respect to the end panel 60 so as to form an angle A1 opening radially inwardly. This angle A1 and a second angle A2 that is defined between the upper panel 56 and the end panel 60 and that also opens radially inwardly toward the center of the end panel 60, are both designed to be about five or six degrees.

Unfortunately, the configuration that is shown in FIG. 7 has been found to be susceptible to pressure induced failure, which occurs when the container is given a positive pressure, such as is required in the packaging of tennis balls. The present inventor has studied the mechanism by which this occurs, and has determined that the interior pressure causes the end panel 60 of the closure to bow upwardly, with the greatest deformation occurring in the centermost part of the panel 60. As this occurs, the outward portions of the end panel 60 are pulled radially inwardly, or to the right as it is viewed in FIG. 7. This causes the lower bead 58 to begin to open, meaning that the angle A1 begins to increase, which reduces the overall strength of the safety fold 50. This culminates in a failure of the closure that is symptomized by an outward folding of the closure over the safety fold 50, the fold line tending to be oriented generally radially.

One solution to this problem is proposed in application Ser. No. 09/578,044, filed May 24, 2000, the entire disclosure of which is incorporated as if set forth fully herein. This solution involves forming the top panel and the intermediate panel so that both are angled radially outwardly and upwardly with respect to the end panel, which increases the resistance of the safety easy-open end against pressure-induced failure. While this solution is believed to hold great promise, it requires an investment in new tooling that would render much of the existing tooling used in the process described in the Morrison et al. patent obsolete.

A need exists for an improved process for manufacturing a safety easy opening end that is more resistant to pressure induced failure than conventional closures of this type, and that requires minimal investment in additional tooling.

SUMMARY OF THE INVENTION

Accordingly, it is an object of the invention to provide an improved process for manufacturing a safety easy opening end that is more resistant to pressure induced failure than conventional closures of this type, and that requires minimal investment in additional tooling.

In order to achieve the above and other objects of the invention, a method of making a safety easy-open end for a container includes, according to a first aspect of the invention, steps of providing an easy-open end of the type that has a double-seaming portion and a safety fold that includes an end panel that extends substantially within a first plane, an intermediate panel that is unitary with and overlies the end panel and that is connected to the end panel by a first bead, a top panel that is unitary with and overlies the intermediate panel and that is connected to the intermediate panel by a second bead, and a transition region that is unitary with and connects the top panel to the double-seaming portion; and performing an operation on the easy-open end so that the top panel is reformed to reside substantially within a second plane and so that the first and second planes intersect at the end panel at a location that is radially inward from the first bead.

These and various other advantages and features of novelty that characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

DETAILED DESCRIPTION OF THE PREFERRED EMBODIMENT(S)

Figure 1:
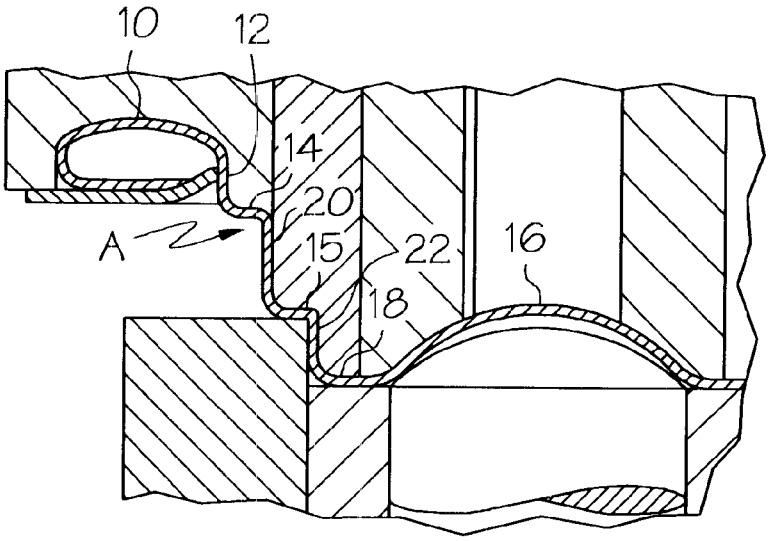
FIG. 1 (Prior Art)
FIGS. 1–6 are fragmentary sectional views showing successive steps in a conventional method of forming a closure incorporating a safety fold.
Figure 2:
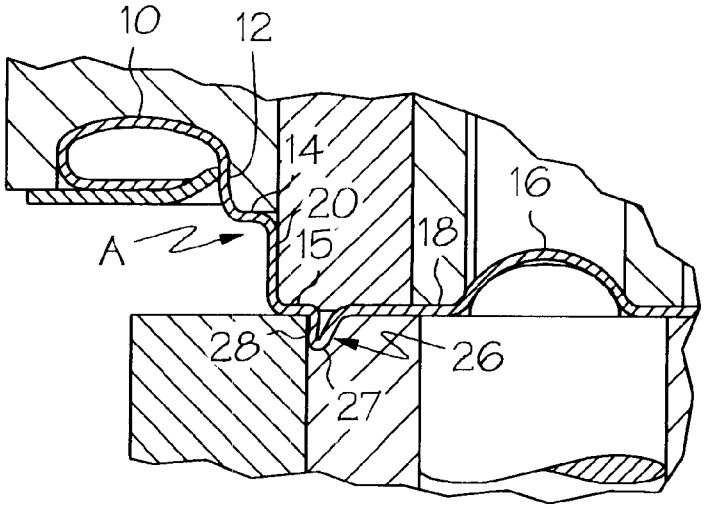
FIG. 2 (Prior Art)
Figure 3:
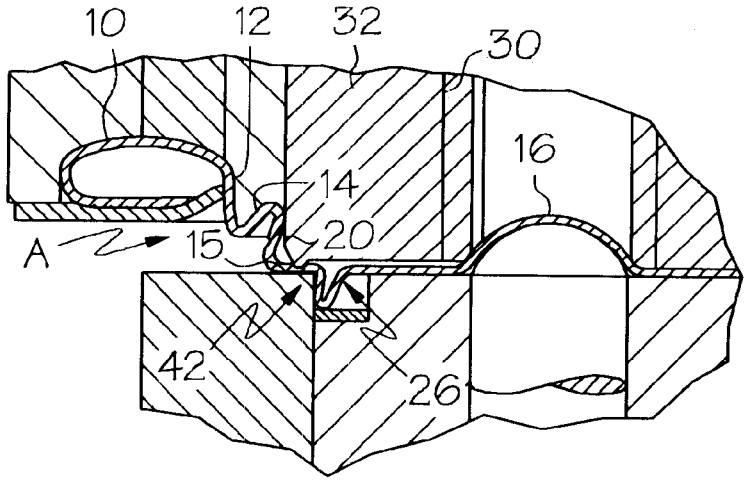
FIG. 3 (Prior Art)
Figure 4:
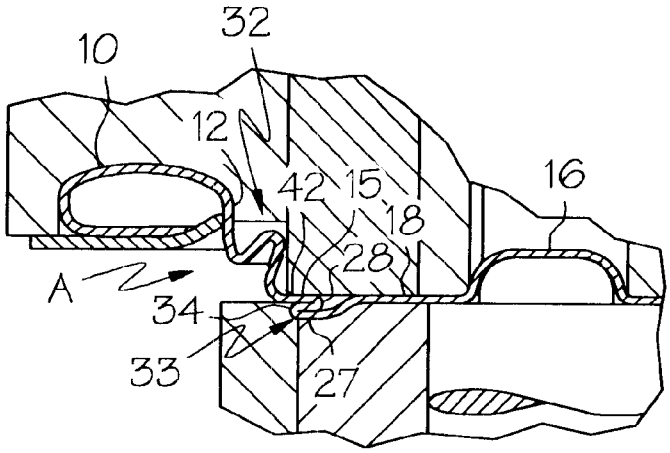
FIG. 4 (Prior Art)
Figure 5:
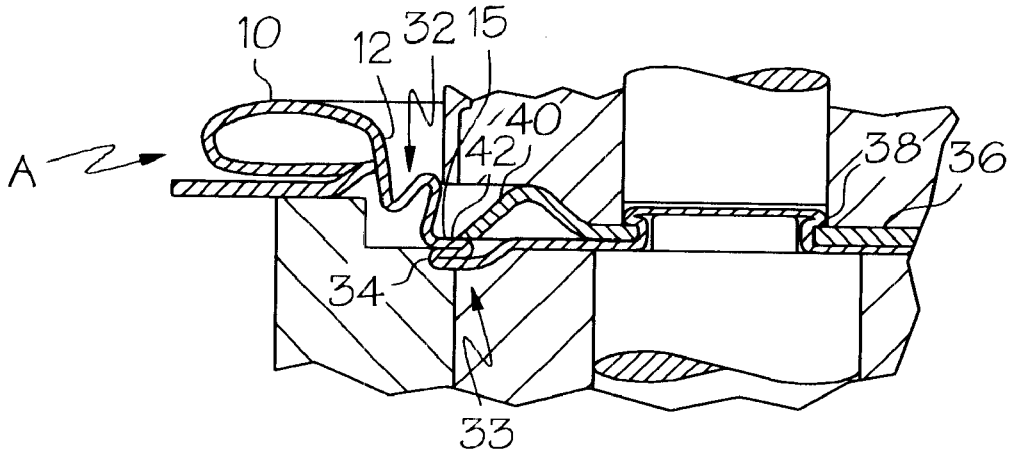
FIG. 5 (Prior Art)
Figure 6:
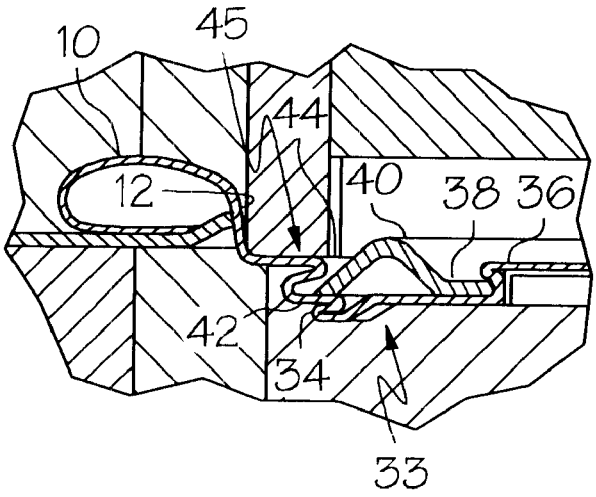
FIG. 6 (Prior Art)
Figure 7:
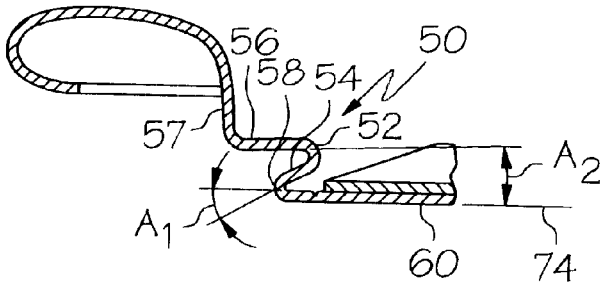
FIG. 7 (Prior Art)
FIG. 7 is a fragmentary sectional view of a conventional completed closure incorporating a safety fold.
Figure 8:
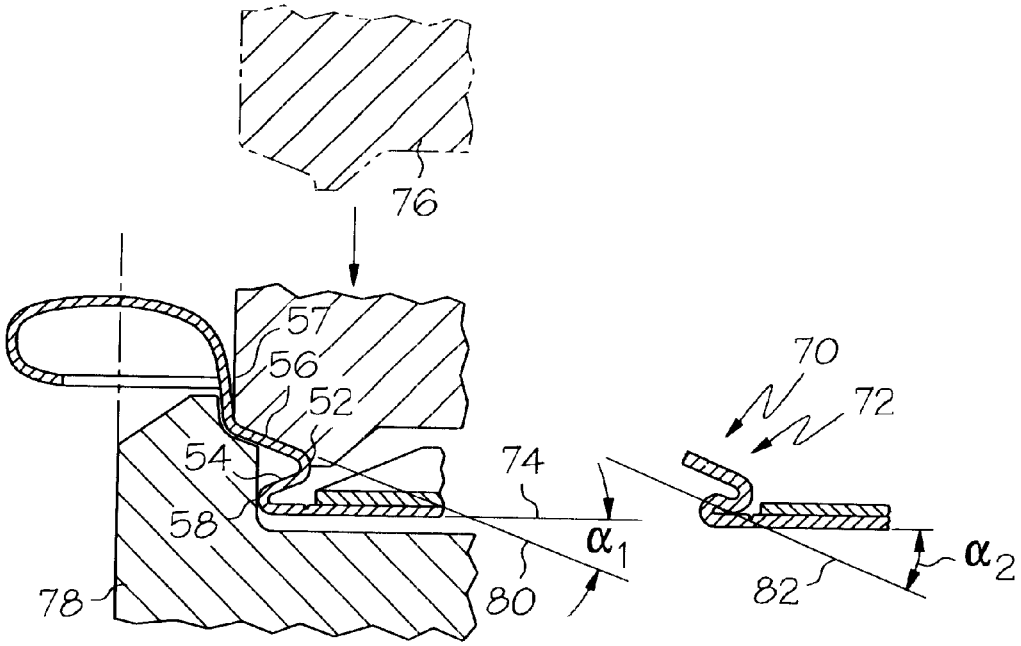
FIG. 8 is a fragmentary diagrammatical sectional view showing an additional operation that is performed according to a preferred embodiment of the invention.

Referring now to the drawings, wherein like reference numerals designate corresponding structure throughout the views, a mechanism or forming station for performing an additional operation on a conventional easy opening can end having a safety fold of the type that is depicted in FIG. 7 in order to form an improved easy open closure 70 having a pressure resistant safety fold 72 is depicted in FIG. 8. As may be seen in FIGS. 7 and 8, the end panel 60 of the conventional easy open closure shown in FIG. 7 is positioned to reside in a first plane 74. The mechanism or forming station shown in FIG. 8 preferably includes a first die 76 and a second die 78, which interact to reform the safety fold so that the top panel 56 is reshaped so as to reside substantially within a second plane 80.

Advantageously, the forming operation in the additional operation according to the preferred embodiment of the invention is performed so that the first and second planes 74, 80 intersect at the end panel 60 at a location that is radially inward from the first, lower bead 58. In other words, the top panel 56 is inclined upwardly and outwardly with respect to the end panel 60. Preferably, the process is performed so that the first and second planes 74, 80 form an angle $\alpha_1$ that is within the range of about 15 degrees to about 45 degrees. More preferably, the first and second planes 74, 80 are formed at an angle $\alpha_1$ that is within the range of about 20 degrees to about 30 degrees. Most preferably, this angle $\alpha_1$ is about 25 degrees.

As may further be seen in FIG. 8, the additional operation is preferably performed so that the intermediate panel 54 resides within a third plane 82, which is preferably substantially parallel to the second plane 80. It follows that the first and third planes 74, 82 intersect at the end panel 60 at a location that is radially inward from the first, lower bead 58 as well. In the most preferred embodiment, the additional operation shown in FIG. 8 is performed so that the first and third planes 74, 82 form an angle $\alpha_2$ that is within the range of about 15 degrees to about 45 degrees, and is more preferably within the range of about 20 degrees to about 30 degrees. Most preferably, the angle $\alpha_2$ formed between the first and third planes 74, 82 is about 25 degrees.

It has been found that the configuration described herein provides superior resistance against pressure induced deformation and failure in a full open easy open container end, such as those that are in demand for the packaging of tennis balls.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A method of making a pressure-resistant easy-open end for a container, comprising steps of:

(a) providing an easy-open end of the type that has a double-seaming portion and a safety fold that includes an end panel that extends substantially within a first plane, an intermediate panel that is unitary with and overlies the end panel and that is connected to the end panel by a first bead, a top panel that is unitary with and overlies the intermediate panel and that is connected to the intermediate panel by a second bead, and a transition region that is unitary with and connects the top panel to the double-seaming portion; and (b) performing an operation on said easy-open end so that said end panel remains substantially within said first plane and so that said top panel is reformed to reside substantially within a second plane so as to extend upwardly and radially outwardly away from said end panel and so that the first and second planes intersect at said end panel at a location that is radially inward from said first bead.

2. A method according to claim 1, wherein step (b) is performed so that said first and second planes form an angle that is within the range of about 15 degrees to about 45 degrees.

3. A method according to claim 2, wherein step (b) is performed so that said first and second planes form an angle that is within the range of about 20 degrees to about 30 degrees.

4. A method according to claim 3, wherein step (b) is performed so that said first and second planes form an angle that is about 25 degrees.

5. A method according to claim 1, wherein step (b) is performed so that said intermediate panel extends substantially within a third plane, and is further performed so that said second and third planes are substantially parallel.

6. A method according to claim 1, wherein step (b) is performed so that said intermediate panel extends substantially within a third plane, and is further performed so that said first and third planes intersect at said end panel at a location that is radially inward from said first bead.

7. A method according to claim 6, wherein step (b) is performed so that said first and third planes form an angle that is within the range of about 15 degrees to about 45 degrees.

8. A method according to claim 7, wherein step (b) is performed so that said first and third planes form an angle that is within the range of about 20 degrees to about 30 degrees.

9. A method according to claim 8, wherein step (b) is performed so that said first and third planes form an angle that is about 25 degrees.

10. A method of making a pressure-resistant easy-open end for a container, comprising steps of:

(a) providing an easy-open end of the type that has a double-seaming portion and a safety fold that includes an end panel that extends substantially within a first plane, an intermediate panel that is unitary with and overlies the end panel and that is connected to the end panel by a first bead, a top panel that is unitary with and overlies the intermediate panel and that is connected to the intermediate panel by a second bead, and a transition region that is unitary with and connects the top panel to the double-seaming portion; and (b) performing an operation on said easy-open end so that said top panel is reformed to reside substantially within a second plane and so that the first and second planes intersect at said end panel at a location that is radially inward from said first bead, step (b) further being performed so that said intermediate panel extends substantially within a third plane so as to extend upwardly and radially outwardly away from said end panel, and is further performed so that said first and third planes intersect at said end panel at a location that is radially inward from said first bead.

11. A method according to claim 10, wherein step (b) is performed so that said first and third planes form an angle that is within the range of about 15 degrees to about 45 degrees.

12. A method according to claim 11, wherein step (b) is performed so that said first and third planes form an angle that is within the range of about 20 degrees to about 30 degrees.

13. A method according to claim 12, wherein step (b) is performed so that said first and third planes form an angle that is about 25 degrees.

* * * * *